US006846797B1

(12) United States Patent
Parker

(10) Patent No.: US 6,846,797 B1
(45) Date of Patent: Jan. 25, 2005

(54) FABRIC CARE COMPOSITION COMPRISING AN EPICHLOROHYDRIN RESIN AND ANIONIC POLYMER

(75) Inventor: Andrew Philip Parker, Wirral (GB)

(73) Assignee: Unilever Home & Personal Care USA a division of Conopco, Inc., Greenwich, CT (US)

( * ) Notice: Subject to any disclaimer, the term of this patent is extended or adjusted under 35 U.S.C. 154(b) by 371 days.

(21) Appl. No.: 10/089,616

(22) PCT Filed: Sep. 27, 2000

(86) PCT No.: PCT/EP00/09589

§ 371 (c)(1),
(2), (4) Date: Jul. 29, 2002

(87) PCT Pub. No.: WO01/25386

PCT Pub. Date: Apr. 12, 2001

(30) Foreign Application Priority Data

Oct. 1, 1999 (GB) ..... 9923279

(51) Int. Cl.[7] ..... C11D 3/37

(52) U.S. Cl. ..... 510/475; 510/276; 510/287; 510/322; 510/330; 510/466; 510/513; 510/515; 510/521; 510/528

(58) Field of Search ..... 510/475, 528, 510/276, 287, 322, 330, 466, 513, 515, 521

(56) References Cited

U.S. PATENT DOCUMENTS

| | | | | |
|---|---|---|---|---|
| 3,949,014 | A | 4/1976 | Maki et al. | |
| 4,121,902 | A | 10/1978 | Guise | |
| 4,371,517 | A | 2/1983 | Vanlerberghe et al. | |
| 6,083,898 | A | 7/2000 | Meixner et al. | |
| 6,255,271 | B1 * | 7/2001 | Carswell et al. | 510/328 |
| 6,277,810 | B2 * | 8/2001 | Baines et al. | 510/475 |

FOREIGN PATENT DOCUMENTS

| | | | |
|---|---|---|---|
| DD | 221922 | | 5/1985 |
| DE | 2837851 | | 3/1980 |
| EP | 0 068 232 | | 1/1983 |
| EP | 0 315 477 | | 5/1989 |
| EP | 0 372 782 | | 6/1990 |
| EP | 0 829 531 | A1 | 3/1998 |
| GB | 1 329 247 | | 9/1973 |
| GB | 2 005 322 | A | 4/1979 |
| GB | 1 549180 | | 7/1979 |
| GB | 2 039 938 | A | 8/1980 |
| GB | 2185499 | * | 7/1987 |
| GB | 2 185 499 | A | 7/1987 |
| GB | 2 202 244 | A | 9/1988 |
| WO | 97/42287 | | 11/1997 |
| WO | 98/17764 | | 4/1998 |
| WO | 98/29530 | | 7/1998 |

OTHER PUBLICATIONS

Patent Act 1977—Search Report under Section 17 (GB 9923279.5—dated Dec. 24, 2002).

International Search Report (PCT/EP 00/09589).

"Handbook of Lipid Bilayers", D. Marsh, CRC Press, Boca Raton, Florida, 1990 (pp. 137 and 337).

"Wet Strength Resins and Their Application", pp. 16–36, ed. LL Chan, Tappi Press, Atlanta, 1994.

* cited by examiner

*Primary Examiner*—Charles Boyer
(74) *Attorney, Agent, or Firm*—Alan A. Bornstein

(57) ABSTRACT

Fabric care compositions adapted for use in a laundering process such as detergent compositions and laundry rinse compositions, comprise at least one reactive cationic polymer (preferably amine- or amide-epichlorohydrin resin or a derivative thereof), at least one reactive anionic polymer and at least one textile compatible carrier. The compositions have improved dye transfer and stain release properties and may be used in methods of treating fabric as part of a laundering process.

15 Claims, No Drawings

FABRIC CARE COMPOSITION COMPRISING AN EPICHLOROHYDRIN RESIN AND ANIONIC POLYMER

TECHNICAL FIELD

This invention relates to fabric care compositions, including detergent compositions and laundry rinse compositions. The invention also relates to methods of treating fabric using the compositions of the invention and to the use of anionic polymers in fabric care compositions.

BACKGROUND AND PRIOR ART

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process.

Fabrics can be damaged in several ways as a result of repeated laundering and/or wear. Fabric pilling and loss of fabric surface appearance eg fuzzing, shrinkage (or expansion), loss of colour from the fabric or running of colour on the fabric (usually termed dye transfer) are some of the common problems associated with repeated laundering. These problems may occur merely from repeated hand washing as well as the more vigorous machine washing process. Furthermore, problems relating to damage of fabric over time through normal use, such as loss of shape and increased likelihood of wrinkling are also significant, especially with articles of clothing.

Laundry detergent compositions containing polyamide-polyamine fabric treatment agents are described in WO 98/29530. The compositions are claimed to impart improved overall appearance to fabrics laundered using the detergent compositions, in terms of surface appearance properties such as pill/fuzz reduction and antifading. Laundry compositions containing polyamide-polyamine treatment agents of similar types are taught in WO 97/42287.

An industrial process for treating fibres is disclosed in U.S. Pat. No. 3,949,014. This document describes the use of a polyamine-epichlorohydrin resin in a binder, together with an amphoteric high molecular weight compound having at least 2 cationic groups and at least 2 anionic groups per molecule. U.S. Pat. No. 3,949,014 mentions the treatment of fabrics with the binder but it is clear that the treatment is intended to be carried out industrially as part of a fabric treatment process rather than as part of a domestic laundering process and this conclusion is supported by the fact that the fabric treated with the binder required curing at a relatively high temperature. Industrial curing of fabrics treated with this type of polymer is normally carried out at about 150° C.

Methods for treating wool with compositions containing an amino functional polymer and a silicone polymer so as to impart shrink resistance are known. However, as described in EP-A-0315477, wool requires a pretreatment before such compositions can be used. Furthermore, EP-A-0372782 explains that the chemistry of wool is quite different from that of cellulosic fibres such as cotton and the requirements for shrink resistance treatments for cotton are generally very different from those for wool.

U.S. Pat. No. 4,371,517 discloses a composition for treating fibrous materials which contain cationic and anionic polymers. In a non-domestic treatment, the compositions increased the rigidity of cotton fabric.

Detergent compositions which prevent dye transfer are taught in EP-A-0068232. The compositions contain non-ionic or zwitterionic surfactants in combination with water-soluble, amino and/or amide group-containing polymers.

WO 98/17764 discloses the use of polyamidoamines, in washing and cleaning compositions, as soil release agents.

Co-emulsifiers, for use in fabric softener and other compositions, which contain cationic quaternary amine polymers, are taught in DD 221922.

GB 2005322 discloses a method of treating textiles which involves treating the materials with a water-soluble polymeric material and an exhaustion agent. The polymers disclosed include the anionic polycarbamoyl-suphonates. The exhaustion agents are inorganic salts.

U.S. Pat. No. 4,121,902 discloses a textile treatment composition which comprise water-soluble anionic polymers (polycarbamoylsuphonates) and at least 20% of a water-insoluble insoluble organic polymer. Optional ingredients which may be present include cationic derivatives of polyamides (such as epichlorohydrin derivatives) or cationic surfactants.

GB 1329247 discloses a process for rendering keratinous or other protein material resistant to shrinkage. The process comprises a treatment with a resin followed treatment with a soil release agent. The resin can be a cationic derivatives of polyamide (such as an epichlorohydrin derivative).

GB 2039938 discloses a textile treatment composition which includes both anionic and cationic polymers.

WO 98/29530 discloses the use of amine-amide epichlorohydrin resins to impart benefits regarding overall appearance, pill-fuzz reduction and antifading in the domestic laundry.

Definition of the Invention

According to the present invention, there is provided a fabric care composition adapted for use in a domestic laundering process and comprising:

a) at least one reactive cationic polymer, which is an amine or amide epichlorhydrin resin, b) at least one reactive anionic polymer of net negative charge, and, c) at least one textile compatible carrier, said reactive polymers each being capable of self cross-linking and/or cross linking to cellulose, wherein the cationic polymer and the anionic polymer are present in amounts such that the overall charge provided by the polymers is positive, and wherein the composition comprises less than 10% of water-insoluble organic polymers.

It is believed that the use of an anionic polymer improves the dye transfer properties of a fabric care composition which comprises a cationic polymer.

It is also believed that use of an anionic polymer improves the stain release properties of a fabric care composition which comprises a cationic polymer.

Also provided by the present invention is a method of treating fabric comprising applying to the fabric a fabric care composition according to the invention as part of a laundering process.

DETAILED DESCRIPTION OF THE INVENTION

Preferably, the reactive cationic polymer is an amine- or amide-epichlorohydrin resin or derivative thereof. Preferably these cationic polymers have a weight average mean molecular weight of from 300 to 1,000,000 Dalton.

The preferred epichlorohydrin resins of the invention are sometimes referred to below as amine-epichlorohydrin resins and polyamine-epichlorohydrin (PAE) resins (the two terms being used synonymously) although these terms encompass both the amine and amide resins of the invention and their derivatives. The resins may also have a mixture of amine and amide groups.

The amine- or amide-epichlorohydrin resins may have one or more functional groups capable of forming azetidinium groups and/or one or more azetidinium functional groups.

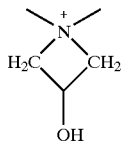

Alternatively, or additionally, the resins may have one or more functional groups that contain epoxide groups or derivatives thereof eg Kymene™ 450 (ex Hercules).

Suitable polyamine-epichlorohydrin (PAE) resins include those described in "Wet Strength Resins and Their Application", pp 16–36, ed. LL Chan, Tappi Press, Atlanta, 1994. Suitable resins can be identified by selecting those resins which impart increased wet strength to paper, after treatment, in a relatively simple test.

Any amine- or amide-epichlorohydrin resin having an epoxide functional group or derivative thereof is suitable for use according to the invention.

A particularly preferred class of amine- or amide-epichlorohydrin resins for use in the invention are secondary amine- or amide-based azetidinium resins, for example those resins derived from a polyalkylene polyamine eg diethylenetriamine (DETA), a polycarboxylic acid eg adipic acid or other dicarboxylic acids, and epichlorohydrin. Other polyamines or polyamides can also be advantageously used in the preparation of suitable PAE resins.

Another preferred class of amine-epichlorohydrin resins for use in the invention are those having an epoxide functional group or derivative thereof eg a chlorohydrin group.

The resin is preferably present in the product in a sufficient quantity to give an amount of 0.0005–5% by weight on the fabric based on the weight of fabric (owf), more preferably 0.001–2% owf. The amount of the resin in the composition required to achieve the above % by weight on fabric will typically be in the range 0.01% to 35% by weight, preferably 0.1% to 13.5% by weight.

The resin may be a PDAA-epichlorohydrin resin or a PMDAA-epichlorohydrin resin. PDAA is poly (diallylamine) and PMDAA is poly(methyldiallyl (amine)).

The fabric care compositions of the invention also comprise at least one reactive anionic polymer.

The reactive anionic polymer is present in the composition in an amount such that the overall negative charge contributed by the anionic groups of the anionic polymer is less than the positive charge provided by the cationic groups of the cationic polymer (such as the amine-epichlorohydrin resin) and any cationic groups in the anionic polymer.

Suitable amounts of reactive anionic polymer in the composition are in the range of from 0.01% to 35% by weight, preferably 0.1% to 13.5% by weight. If the overall charge provided by the anionic polymer and the cationic polymer, as described above, is not positive, it is believed that the cationic polymer tends not to impart the benefits to the fabric which are imparted to the fabric in the absence of the anionic polymer.

The anionic polymer may be any polymeric compound having a single unit which repeats in the compound, on average at least five times, a plurality of anionic groups and a molecular weight of at least 400 Dalton, preferably at least 600 Dalton. The anionic polymer has negatively charged groups which may be present in the repeating group and/or at one or both of the ends of the polymer chain and may be introduced during polymerisation or after the polymer has been formed. The anionic polymer may contain cationic groups as well as anionic groups but the net charge on the polymer chain must be negative. The anionic polymer can be wholly or partly amphoteric, provided that it is capable of having a net negative charge in the presence of the cationic polymer. It is preferred that the anionic polymer comprises anionic groups which are oxo-anions of sulphur, carbon or phosphorus, or derivatives thereof such as, for example sulphonate ($SC_3^-$) and carboxylate ($CO_2^-$) groups.

Preferred anionic polymers are polyisocyanate derivatives, preferably the bisulphite addition products such as polycarbamoyl sulphamates. Preferably, the anionic polymer is selected from carbamoyl sulphonate terminated poly (ether)urethane resins, bunte salt terminated polymers and mixtures thereof. Suitable polymers include those having the formula (I):

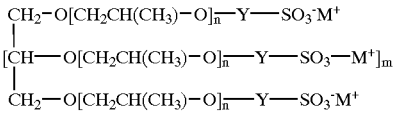

(I)

wherein:

Y is a divalent radical selected from —$CH_2$—CH(OH)—$CH_2$—S— and —CO—NH— $(CH_2)_p$—NH—CO—;

m is an integer from 0 to 4;

n is an integer from 5 to 20;

M is an alkali metal; and p is an integer from 2 to 12.

Preferably, m is equal to 1.

Conveniently, Y is —CO—NH— $(CH_2)_p$—NH—CO— and, preferably, p is from 4 to 8, such as about 6.

It is also preferred that n is 10 to 15, such as about 13, for example.

M is advantageously sodium or potassium, more preferably sodium.

Polymers in which Y is —CO—NH—$(CH_2)_p$—NH—CO— are commercially available under the Trade Mark SYNTHAPPRET BAP (Bayer).

Polymers in which Y is —$CH_2$—CH(OH)—$CH_2$—S— are available under the Trade Mark NOPCOLAN SHR3 (Henkel).

The compositions of the invention, when applied to a fabric, may be cured by a domestic curing step including ironing and/or domestic tumble drying, preferably tumble drying. Preferably, these curing steps are carried out at temperatures in the range of from 60 to 100° C., more preferably from 80 to 100° C.

The compositions of the invention may be used before, during or after a conventional laundry process and are preferably packaged and labelled as such. The laundry process includes large and small scale processes, and is preferably a domestic process.

When the compositions of the invention are to be used before or after the laundry process, they may be in the form of a spray or foaming product.

When the compositions of the invention are to be used during the laundry process, they may be used at any convenient stage of the process, such as, for example, in a pre-wash composition, in the main wash detergent composition and/or a rinse composition.

In the context of the present invention the term 'textile compatible carrier' means a component which can assist in the interaction of the cationic polymer with the fabric.

The carrier can also provide benefits in addition to those provided by the cationic polymer e.g. softening, cleaning etc. The nature of the carrier will depend upon at what stage of the laundry process the composition of the invention is used. The carrier may be water or a detergent-active compound or a fabric softener or conditioning compound or other suitable detergent or fabric treatment agent.

If the composition of the invention is to be used in a laundry process as part of a conventional fabric treatment product, such as a detergent composition, the textile-compatible carrier will typically be a detergent-active compound. Whereas, if the fabric treatment product is a rinse conditioner, the textile-compatible carrier will be a fabric softening and/or conditioning compound.

Detergent Active Compounds

If the composition of the present invention is in the form of a detergent composition (such as a main wash composition), the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkyl sulphates, particularly $C_8$–$C_{15}$primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are independently hydrocarbyl chains of $C_1$–$C_{22}$ length, typically alkyl, hydroxyalkyl or ethoxylated alkyl groups, and X is a solubilising anion (for example, compounds in which $R_1$ is a $C_9$–$C_{22}$ alkyl group, preferably a $C_9$–$C_{10}$ or $C_{12}$–$C_{14}$alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt %, eg 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 55% by weight, eg 5 to 30% by weight.

Preferably, the quantity of anionic surfactant is in the range of from 3 to 35% by weight, eg 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O\ Al_2O_3,\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Fabric Softening and/or Conditioner Compounds

The compositions of the invention may be in the form of a rinse composition, such as a fabric conditioner composition.

Therefore, also provided by the present invention are laundry rinse compositions comprising at least one reactive cationic (preferably amine- or amide-epichlorohydrin) resin, at least one reactive anionic polymer and at least one textile compatible carrier. The laundry rinse compositions may contain an anionic surfactant which may be one or more of the anionic surfactants which may be used in the detergent active compositions described above. The rinse compositions may contain both an anionic polymer and an anionic surfactant and contain an amount of anionic polymer and/or anionic surfactant which provides a total negative charge from its anionic groups that is not greater than the total positive charge provided by the cationic groups of the amine-epichlorohydrin resin and any cationic groups in the anionic polymer. Suitable amounts of both the cationic (preferably amine-epichlorohydrin) resin and the total anionic polymer and/or anionic surfactant are in the range of from 0.01 to 35% by weight, (preferably 0.1% to 13.5% by weight, more preferably 3 to 7% by weight) so as to provide an amount of the components on the fabric of from 0.0005 to 5% by weight of the fabric, preferably 0.001 to 2% by weight of the fabric.

If the fabric care composition or the laundry rinse composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble, non-polymeric, quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate eg a flexible sheet or sponge or a suitable dispenser (such as a container having apertures therein, for example) during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example distearyldimethyl ammonium chloride and di (hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337). Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

(II)

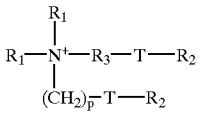

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein —$R_3$— is a linear or branched alkylene group of 1 to 5 carbon atoms, T is

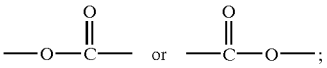

and p is 0 or is an integer from 1 to 5.

Di (tallowoyloxyethyl) dimethyl ammonium chloride and/or its hardened tallow analogue is especially preferred of the compounds of formula (II).

A second preferred type of quaternary ammonium material can be represented by the formula (III):

(III)

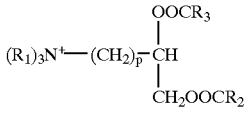

wherein $R_1$, p and $R_2$ are as defined above.

It is advantageous if the quaternary ammonium material is biologically biodegradable.

Preferred materials of this class such as 1,2-bis (hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1966, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof. Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominantly linear polydialkylsiloxanes, eg polydimethylsiloxanes or amino-silicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants. Preferably, the silicone component is a dimethylpolysiloxane with aminoalkyl groups.

Preferably the ratio of amine- or amide-epichlorohydrin resin to the silicone component is from 1:1 to 30:1.

The fabric conditioning compositions may also include an agent which produces a pearlescent appearance, eg an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, anti-shrinking agents, anti-wrinkle agents, anti-spotting agents, dye transfer inhibitors, germicides, fungicides, anti-oxidants, UV absorbers (sunscreens), heavy metal sequestrants, chlorine scavengers, dye fixatives, anti-corrosion agents, drape imparting agents, antistatic agents and ironing aids.

This list is not intended to be exhaustive.

Fabric Treatment Products

The composition of the invention may be in the form of a liquid, solid (eg powder or tablet), a gel or paste, spray, stick or a foam or mousse. Examples include a soaking product, a rinse treatment (eg conditioner or finisher) or a mainwash product. The composition may also be applied to a substrate (eg a flexible sheet) or used in a dispenser which can be used in the wash cycle, rinse cycle or during the dryer cycle.

The fabric care compositions of the present invention have been found to possess the advantages of compositions containing cationic amine-epichlorohydrin resins, such as improved surface colour definition of the fabric following multiple washings and/or improved dimensional stability of the fabric and/or reduced fabric fibrillation. Moreover, the compositions of the invention exhibit reduced dye transfer and/or improved stain release properties relative to those compositions.

The use of anionic polymers to improve the dye transfer properties of a fabric care composition and/or to improve the stain release properties of a fabric care composition is applicable to compositions containing amine-epichlorohydrin resins and/or other cationic polymers. Fabrics treated with the compositions of the invention can also exhibit beneficial properties due to the anionic polymer itself, such as antistatic properties, for example.

The fabrics which may be treated in the present invention may be in the form of garments and preferably comprise cellulosic fibres, preferably from 1% to 100% cellulosic fibres (more preferably 5% to 100% cellulosic fibres, most preferably 40% to 100% such as 75% to 100%). When the fabric contains less than 100% cellulosic fibres, the balance comprises other fibres or blends of fibres suitable for use in garments such as polyester or polyamide, for example. Preferably, the cellulosic fibres are of cotton or regenerated cellulose such as viscose.

The invention will now be described by way of example only and with reference to the following non-limiting examples.

EXAMPLES 1 TO 2

Fabric Preparation

All samples were prepared by repeating the following method five times:

730 g of fabric (3 pieces undyed woven cotton sheeting, 1 piece of printed fabric for fabric care evaluation) was washed at 40° C. on a cotton wash cycle with 35 g of Persil Original Non-Biological (trade mark) detergent. Samples were treated by rinse applying the required amount of product in the rinse cycle.

The products applied were:

Control–0.1% Apomul SAK™ (polyamine-epichlorohydrin resin, as about 13% aqueous solution, Brookstone Chemicals)

Example 1–0.1% Apomul SAK™+0.1% Synthappret BAP™

Example 2–0.1% Apomul SAK™+0.15% Synthappret BAP™

Synthappret BAP™ is a polycarbamoyl sulphonate (a bisulphite adduct of a polyisocyanate).

After the five applications, samples of each treatment were evaluated for dye transfer and stain release.

Dye transfer 30 cm square samples of the control and the product treated according to the invention were washed at 40° C. on a cotton wash cycle in a Zanussi Jetsystem 1200 (trade mark) washing machine with 35 g of Persil Original Non-Biological (trade mark) detergent together with Direct Red 80 standard cloths at a ratio of 6:1 treated:Direct Red 80 followed by tumble drying in a Miele Novotronic T430 (trade mark) tumble dryer on "extra dry" setting. The change in colour (ΔE) of the treated fabrics relative to untreated cloth subjected to the same dye transfer test was then measured using the Spectraflash (trade mark) spectrometer.

| Treatment | ΔE |
|---|---|
| Control | 8.12 |
| Example 1 | 4.92 |
| Example 2 | 4.49 |

Stain Release

Samples of the treated fabrics had 1 ml of red wine applied to the centre of the sample. After the wine had soaked in, the sample was left under ambient conditions for five days. The stained area was then measured using the Spectraflash (trade mark) spectrometer. The samples were then washed at 40° C. with 35 g of Persil Biological Powder (trade mark), tumble dried and the stains measured again.

| Treatment | ΔE of stain | ΔE after washing | ΔΔE |
|---|---|---|---|
| Control | 25.36 | 11.82 | 13.54 |
| Example 1 | 25.82 | 12.15 | 13.67 |
| Example 2 | 25.39 | 10.28 | 15.11 |

In this case the larger ΔΔE value, the more stain has been removed (ie the colour is paler).

Garment Care Benefits

The method used to determine the garment care benefit from the cationic polymers involved the determination of the effect of washing treatment on the colour and lightness of a printed fabric which is particularly susceptible to surface damage which appears as a change in the colour of the print.

The load used for the experiment consisted of three pieces of woven cotton sheeting 1 m×1.52 m weighing approximately 700 g in total, and a piece of the printed fabric measuring 0.5 m×1 m weighing approximately 30 g, giving a total load weight of 730 g. This allows the fabric freedom to move within the machine resulting in more damage.

The wash was carried out in a Zanussi Jetsystem 1200 (trade mark) washing machine at 40° C. using 35 g of Persil Original Non-Biological (trade mark) washing powder in the main wash. Treatments were applied in the rinse at a level to deliver 0.2% o.w.f of active ingredient.

After each cycle, the load was tumble dried in a Miele Novotronic T430 (trade mark) dryer using the extra-dry setting.

After five wash/dry cycles, the appearance was compared to an untreated sample and colour measurements were taken as necessary.

Where colour measurements were taken, the greater the change in colour (ΔE) or lightness (ΔL) indicates more severe damage which causes the colour to change more dramatically. The smaller the ΔE and ΔL values, the closer the fabric appearance is to the original, indicating a positive garment care benefit.

Colour measurements were carried out on areas of the printed fabric which had been dyed black and red. The results are as follows:

| Treatment | ΔL | ΔE |
|---|---|---|
| i. Black | | |
| None | 9.94 | 10.07 |
| 0.1% Apomul SAK ™ | 4.15 | 4.25 |
| 0.2% Apomul SAK ™ | 4.29 | 4.57 |
| 0.2% Synthappret BAP ™ | 8.66 | 8.72 |
| Example 1 | 2.46 | 2.61 |
| Example 2 | 2.77 | 2.82 |
| ii. Red | | |
| None | 3.30 | 12.62 |
| 0.1% Apomul SAK ™ | 0.91 | 6.11 |
| 0.2% Apomul SAK ™ | 0.71 | 5.85 |
| 0.2% Synthappret BAP ™ | 2.79 | 11.24 |
| Example 1 | 0.43 | 5.56 |
| Example 2 | 0.66 | 5.04 |

The results for the red and black areas of the printed fabric show that, in both cases, the colour care benefits of the cationic polymers are not only maintained but are surprisingly improved upon by the cationic/anionic polymer compositions of the invention.

What is claimed is:

1. Fabric care composition adapted for use in a domestic laundering process and comprising:

a) at least one reactive cationic polymer, which is an amine- or amide-epichlorohydrin resin;

b) at least one reactive anionic polymer of a net negative charge;

c) at least one surfactant, and d) at least one textile compatible carrier, said reactive polymers each being capable of self cross-linking and/or cross linking to cellulose, wherein the cationic polymer and the anionic polymer are present in amounts such that the overall charge provided by the polymers is positive, and wherein the composition comprises less than 10% of water-insoluble organic polymers.

2. Composition as claimed in claim 1, wherein the reactive cationic polymer is present in the composition in an amount of from 0.01 to 35% by weight.

3. Composition as claimed in claim 1 wherein the reactive anionic polymer is present in the composition in an amount of from 0.01 to 35% by weight.

4. Composition as claimed in claim 1, wherein the amine- or amide-epichlorohydrin resin has one or more functional groups capable of forming azetidinium groups.

5. Composition as claimed in claim 1, wherein the amine- or amide-epichlorohydrin resin has one or more azetidinium groups.

6. Composition as claimed in claim 1, wherein the amine- or amide-epichlorohydrin resin has one or more functional groups that contain epoxide groups or derivatives thereof.

7. Composition as claimed in claim 1, wherein the anionic polymer comprises carboxylate groups, sulphonate groups, or a combination thereof.

8. Composition as claimed in claim 7 which is a laundry rinse composition.

9. Composition as claimed in claim 8 which comprises a fabric conditioning and/or softening compound.

10. Composition as claimed in claim 8 which further comprises a silicone component.

11. Composition as claimed in claim 10, wherein the ratio of amine- or amide-epichlorohydrin resin to the silicone component is from 1:1 to 30:1.

12. Composition as claimed in claim 1 which further comprises a perfume.

13. A method of treating fabric comprising applying to a fabric a fabric care composition of claim 1 as part of a laundering process.

14. A method as claimed in claim 13, wherein the composition is applied to the fabric during the rinse cycle.

15. A method as claimed in claim 13, wherein the fabric comprises cellulosic fibres.

* * * * *